US008414339B1

(12) United States Patent
Glick et al.

(10) Patent No.: US 8,414,339 B1
(45) Date of Patent: Apr. 9, 2013

(54) ELECTRICAL TERMINAL AND RECEPTACLE ASSEMBLY

(75) Inventors: Michael Glick, Farmington Hills, MI (US); Slobodan Pavlovic, Novi, MI (US); Allen Leo Mott, Livonia, MI (US); Reshma Rathod, Auburn Hills, MI (US); Tulasi Sadras-Ravindra, Canton, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 13/285,393

(22) Filed: Oct. 31, 2011

(51) Int. Cl.
*H01R 13/187* (2006.01)

(52) U.S. Cl. ..... 439/843; 439/357

(58) Field of Classification Search ..... 439/843–847, 439/827, 607.17
See application file for complete search history.

(56) References Cited

U.S. PATENT DOCUMENTS

| | | | | |
|---|---|---|---|---|
| 3,161,451 | A * | 12/1964 | Neidecker | 439/268 |
| 4,714,441 | A | 12/1987 | Corman | |
| 5,591,039 | A | 1/1997 | Matthews | |
| 5,730,628 | A * | 3/1998 | Hawkins | 439/843 |
| 6,042,432 | A * | 3/2000 | Hashizawa et al. | 439/843 |
| 6,048,225 | A | 4/2000 | Dechanteloup et al. | |
| 6,102,751 | A | 8/2000 | Becker | |
| 6,190,215 | B1 | 2/2001 | Pendleton et al. | |
| 6,254,439 | B1 | 7/2001 | Endo et al. | |
| 6,264,508 | B1 | 7/2001 | Lehmann | |
| 6,811,453 | B2 | 11/2004 | Williams | |
| 7,101,192 | B1 | 9/2006 | Bordeau et al. | |
| 7,393,252 | B2 | 7/2008 | Ribeau et al. | |
| 7,416,453 | B2 | 8/2008 | Germani | |
| 7,537,472 | B1 | 5/2009 | Schwarz et al. | |
| 7,578,708 | B2 | 8/2009 | Hachadorian | |
| 7,828,609 | B2 | 11/2010 | Li et al. | |
| 7,841,912 | B2 | 11/2010 | Hachadorian | |
| 7,909,236 | B2 | 3/2011 | Erdie | |
| 7,963,793 | B2 | 6/2011 | Poulin et al. | |
| 7,972,167 | B2 | 7/2011 | Amit et al. | |
| 8,078,280 | B2 * | 12/2011 | Sage | 607/37 |
| 8,096,829 | B2 * | 1/2012 | Malloy et al. | 439/578 |

(Continued)

FOREIGN PATENT DOCUMENTS

| | | | |
|---|---|---|---|
| DE | 102009044179 | A1 | 12/2010 |
| WO | 2010060370 | A1 | 6/2010 |
| WO | 2010128263 | A1 | 11/2010 |

OTHER PUBLICATIONS

U.S. Appl. No. 13/214,376, filed Aug. 22, 2011, 23 pages.
U.S. Appl. No. 13/285,384, filed Oct. 31, 2011, 26 pages.
U.S. Appl. No. 13/101,592, filed May 5, 2011, 23 pages.

*Primary Examiner* — Tho D Ta
*Assistant Examiner* — Travis Chambers
(74) *Attorney, Agent, or Firm* — Brooks Kushman P.C.

(57) ABSTRACT

A terminal has a body sized to be received within a receptacle. An intermediate region extends lengthwise from the body in a receptacle direction. At least one portion of the intermediate region extends centrally inward into the receptacle to receive a pin to deform and maintain contact with the received pin. A retention member is provided on a distal end of the central extending portion to engage an inner wall of the receptacle and, during deformation, to extend along the wall thereby providing a reaction force to the at least one portion of the intermediate region to enhance contact with the pin and to enhance contact with the receptacle. A receptacle assembly is provided for receiving one or plurality of terminals.

17 Claims, 3 Drawing Sheets

U.S. PATENT DOCUMENTS

2002/0122690 A1 9/2002 Poon et al.
2003/0040228 A1 2/2003 Finzer et al.
2003/0163171 A1* 8/2003 Kast et al. ..... 607/36
2008/0254670 A1 10/2008 Balsells et al.
2010/0311266 A1 12/2010 Dilmaghanian et al.
2011/0034053 A1 2/2011 Matsumoto et al.
2011/0171850 A1 7/2011 Brown, II
2011/0201223 A1 8/2011 Kurumizawa et al.

* cited by examiner

ELECTRICAL TERMINAL AND RECEPTACLE ASSEMBLY

TECHNICAL FIELD

Various embodiments relate to electrical terminals for facilitating electrical connectivity, and receptacle assemblies comprising electrical terminals.

BACKGROUND

Electrical terminals are used in a number of applications to facilitate electrical connecting of one element to another. Some electrical terminals may be configured to facilitate use with a removable connector of the type that may be repeatedly inserted and removed or otherwise configured to repeatedly engage and disengage the electrical terminal. The ability of the electrical terminal to facilitate electrical connectivity with such a removable connector can be problematic if an electrical connection area between the terminal and connector has poor connectivity, particularly when tolerance variations or degradation from repeated use causes a mating arrangement between the components to become loose or otherwise insecure.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
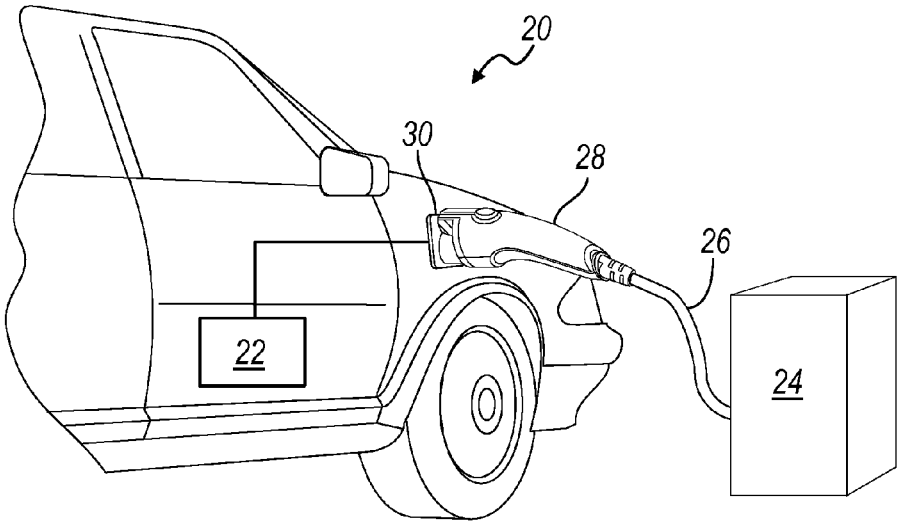
FIG. 1 is a schematic of a charging system utilizing a charging connector assembly according to an embodiment.

FIG. 1 illustrates a charging system 20 operable to facilitate charging of a vehicle charging system 22 with energy provided from a wall outlet or charging station 24 as contemplated according to an embodiment. The system 20 may include a cordset 26 having plurality of conducting wires and/or other conducting elements to facilitate delivering current between the charging station 24 and the vehicle charging system 22. One end of the cordset 26 may include a connector assembly 28 configured to be received within a charging receptacle 30 associated with the vehicle charging system. The connector assembly 28 may be of the type described in U.S. Pat. No. 7,878,866 to Kwasny et al., the disclosure of which is hereby incorporated by reference in its entirety.

The charging receptacle 30 may be configured to facilitate establishment of an electrical connection between a plurality of electrically conducting elements of the vehicle charging system 22 and the charging station 24. The charging receptacle 30 may facilitate the desired electrical connection by providing interconnecting conducting elements and/or by guiding the vehicle charging system 22 and conducting elements of the connector assembly 28 into a mating arrangement with each other. The charging receptacle 30 may be configured to support a multiple pin or port connection methodology for facilitating electrically interconnecting the vehicle charging system 22 and the conducting elements of the connector assembly 28, including but not limited to that specified in Society of Automotive Engineer (SAE) J1772 and International Electrotechnical Commission (IEC) 51851.

Figure 2:
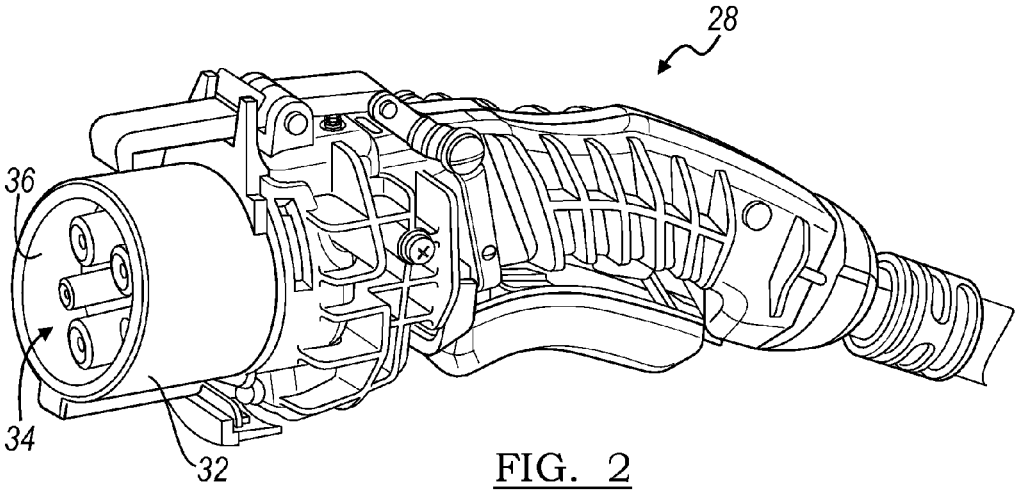
FIG. 2 is a partially disassembled perspective view of the charging connector assembly of FIG. 1, utilizing a plurality of receptacle assemblies.

FIG. 2 illustrates the connector assembly 28 with a male charging connector 32 for receipt within the receptacle 30. The illustrated charging connector 32 may be configured to facilitate electrically interconnecting vehicle charging system conducting elements with conducting elements of the cordset 26 by guiding the elements into engagement with each other. The charging connector assembly 28 may include a plurality of female receptacle assemblies 34 for receiving pins their within the charging receptacle 30. The receptacle assemblies 34 are oriented within a cavity 36 of the connector 32 and may be configured to facilitate interconnecting of pins within the charging receptacle 30 with wires included within the cordset 26.

The charging system 20 and the particular components disclosed in FIGS. 1 and 2 are for example only and depict one embodiment for utilizing the receptacle assemblies 34. Of course, the receptacle assemblies 34 may be employed at any electrical connection wherein a female receptacle receives a pin.

Figure 3:
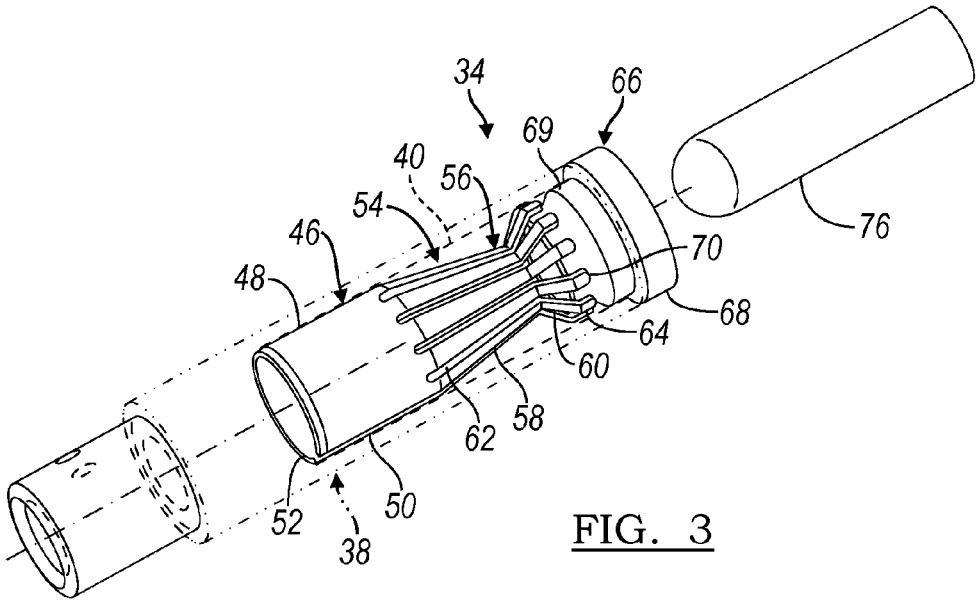
FIG. 3 is a side perspective view of one of the receptacle assemblies of FIG. 2, illustrated with a pin prior to insertion.
Figure 4:
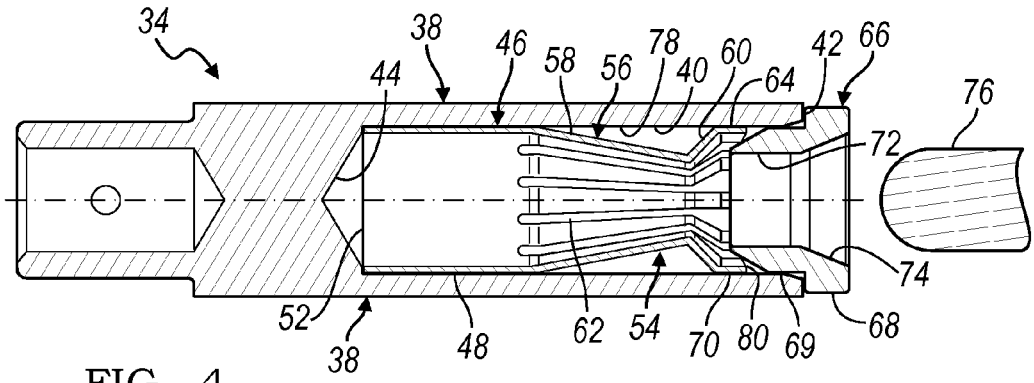
FIG. 4 is a side section view of the receptacle assembly and pin of FIG. 3, illustrated prior to insertion.

Referring now to FIGS. 3 and 4, the receptacle assembly 34 is illustrated with a receptacle housing 38. The receptacle housing 38 may be similar to an embodiment disclosed in U.S. patent application Ser. No. 13/214,376 filed on Aug. 22, 2011 by Mott et al., which is incorporated by reference herein. The receptacle housing 38 has a bore or receptacle 40 formed therein. The receptacle 40 has an opening 42 and a blind depth end 44. The receptacle housing 38 may be generally hollow and cylindrical in shape. Of course, the housing 38 may have any suitable shape and is not limited to having a blind depth. The housing 38 may be formed of any suitable material, such as a conductive material that is adequately rigid. Alternatively, the housing 38 may be formed from an insulation material with wiring for the electrical connection. According to another embodiment, the receptacle housing 38 may be insulated on its exterior.

An electrically conductive terminal 46 is received within the receptacle 40. In the depicted embodiment, the terminal 46 contacts the receptacle 40 for providing an electrical connection between the terminal 46 and the receptacle 40. As stated above, the housing 38 may include wiring for providing an electrical connection to the terminal 46.

The terminal 46 has a generally cylindrical body 48 that is received within the receptacle 40. The terminal 46 may be formed of an electrically conductive spring metal, such as a spring tempered alloy or a binary metal such as copper clad steel. The cylindrical body 48 is formed with an outer diameter that is greater than an inner diameter of the receptacle 40 for a press or friction fit within the receptacle 40. The body 48 has a lengthwise slit 50 formed through the body 48 so that the body 48 is under compression when installed in the receptacle 40. In the depicted embodiment a proximate end 52 of the body 48 of the terminal 46 is installed against the blind depth end 44 of the receptacle 40. Additionally, the terminal 46 may be bonded to the receptacle housing 38 by sonic welding or any suitable manufacturing process.

The terminal 46 has an intermediate region 54 with a plurality of beams or leaf springs 56 oriented generally in a radial array and extending lengthwise from the body 48 toward the receptacle opening 42. Each leaf spring 56 has a first angled portion 58 that extends centrally inward and longitudinally away from the body 48. Additionally, each leaf spring 56 has a second angled portion extending radially outward from the first angled portion 58 and extending toward the receptacle opening 42. The leaf springs 56 are spaced apart circumferentially with gaps 62 between consecutive leaf springs 56. Although the first and second angled portions 58, 60 are illustrated and described, any suitable geometry, such as curved leaf springs may be utilized.

A retention member 64 is provided on a distal end of each leaf spring 56 extending longitudinally toward the receptacle opening 42 from the second angled portion 60. The leaf springs 56 are collectively under compression upon installation whereby the retention members 64 have an unloaded outside diameter that exceeds the inner diameter of the receptacle 40. When installed as illustrated in FIGS. 3 and 4, the leaf springs 56 collectively converge as permitted by the gaps 62.

The receptacle assembly 34 also includes a retainer 66 secured to the receptacle opening 42 for reducing a diameter of the receptacle opening 42. The retainer 66 may be similar to an embodiment disclosed in U.S. patent application Ser. No. 13/214,376 filed on Aug. 22, 2011 by Mott et al., which is incorporated by reference herein. The retainer 66 may be insulated to prevent inadvertent electrical communication with the opening end of the receptacle housing 38. The retainer 66 has a shoulder 68 abutting the opening 42. The retainer 66 also has a body 69 extending into the receptacle 40 with a tapered surface 70 which may extends centrally within the retention member 64 of the terminal 46. The retainer 66 has a reduced inner diameter 72 and a leading-edge 74 for guiding a pin 76 into the receptacle 40 for engagement with the leaf springs 56 of the terminal 46.

Figure 5:
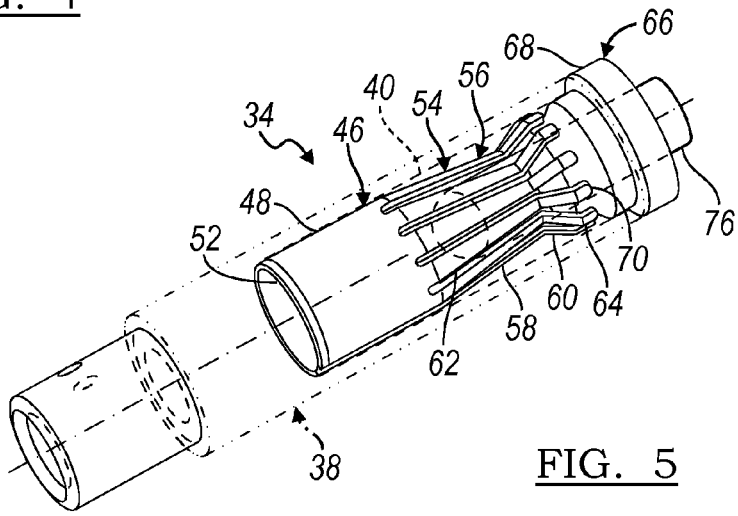
FIG. 5 is a side perspective view of the receptacle assembly and pin of FIG. 3, illustrated after insertion.
Figure 6:
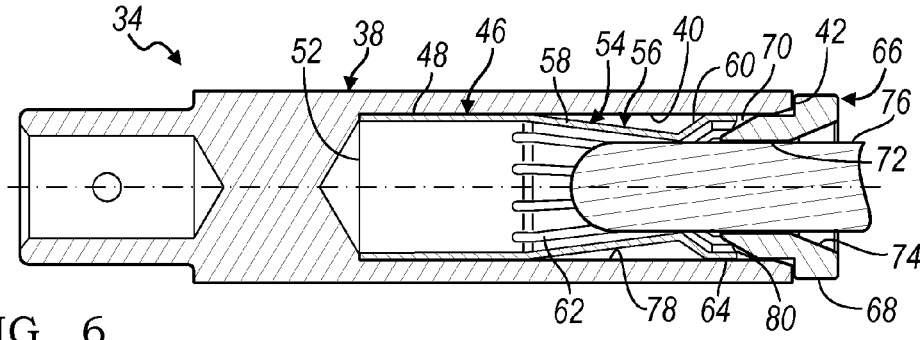
FIG. 6 is a side section view of the receptacle assembly and pin of FIG. 3, illustrated after insertion.
Figure 7:
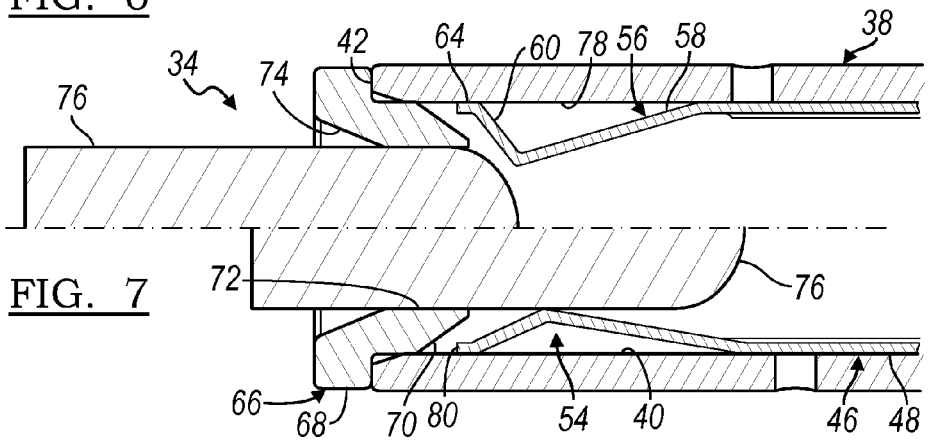
FIG. 7 is a side section view of the receptacle assembly and pin of FIG. 3, illustrated prior to insertion, and before engagement of the pin and a terminal in a top half of the Figure, and after engagement of the pin and the terminal in the bottom half of the Figure.

Referring to FIGS. 5 and 6, the pin 76 extends within the receptacle 40 due to translation of the receptacle housing 38 relative to the pin 76. Receipt of the pin causes the leaf springs 56 to collectively diverge and expand due to engagement with the pin 76. FIG. 7 illustrates this relationship in greater detail. The first and second angled portions 58, 60 become flattened during engagement with the pin 76 thereby expanding each leaf spring 56. The retention members 64 extend along an inner wall 78 of the receptacle 40 to provide a reaction force for the leaf springs 56. Each retention member 64 may also have a distal end abutment surface 80, which may engage the retainer 66 as illustrated in FIG. 6 for axial loading the terminal 46.

The retention members 64 extend in a lengthwise direction to maintain contact with the receptacle housing 38 when in contact with the pin 76. The reaction force provided to the leaf springs 56 optimizes surface engagement with the pin 76 for enhancing the contact and consequently conductivity. Likewise, the retention members 64 are oriented generally cylindrically for optimizing overall contact of the terminal 46 with the receptacle housing 38 for enhancing contact surface area and consequently conductivity.

Each leaf spring 56 provides two contact points with the receptacle housing 38 when deformed by the pin 76—one contact point at the retention member 64 and another contact point at the body 48, or at a proximal end of the leaf spring 56. The two contact points create a dual electrical pass for current, thereby improving performance. The dual contacts increase a reaction force within the confines of the receptacle 40, which enhances the reliability of the connection for a compact connection.

The terminal 46 may be formed integrally from a single sheet of stamped spring tempered alloy or binary metal. The sheet of material may have a length from the proximate end 52 of the terminal body 48 to the distal end abutment surface 80 of the retention member 64. The distal end abutment surface 80 may be provided by a thickness of the sheet of material. The sheet of material may have a width terminating at lateral ends that are formed together to collectively provide the slit 50. The sheet of material may be rolled about a lengthwise or central axis of the terminal 46.

The terminal 46 may be utilized in the connector assemblies 28 for vehicle charging systems 22. Such systems often employ high-voltage charging, which is most effective if contact of electrical connections is optimized. Additionally, such vehicle charging systems 22 are exposed to harsh environments and undergo multiple mating cycles. The terminal 46 improves contact of the receptacle housing 38 with the terminal 46 as well as contact of the terminal 46 with the pin 76. These improved contacts improve the durability of the terminal 46 and consequently the durability of the receptacle housings 38 and the connector assembly 28.

Figure 8:
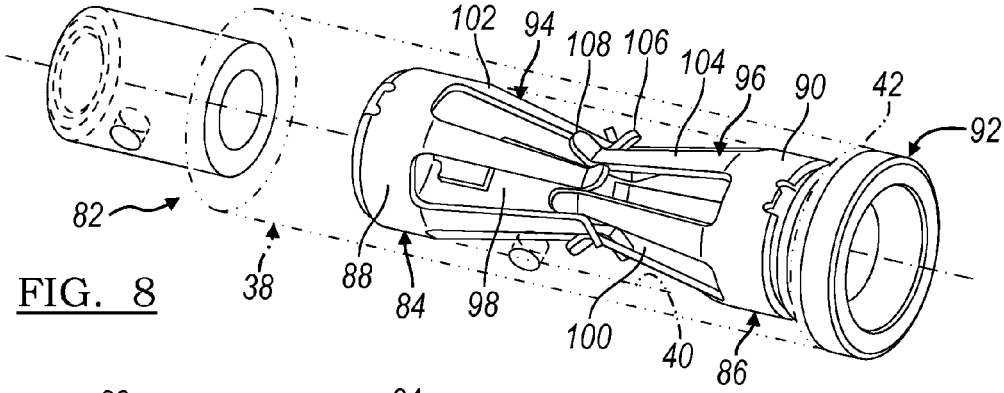
FIG. 8 is a side perspective view of a receptacle assembly of FIG. 2 according to another embodiment.
Figure 9:
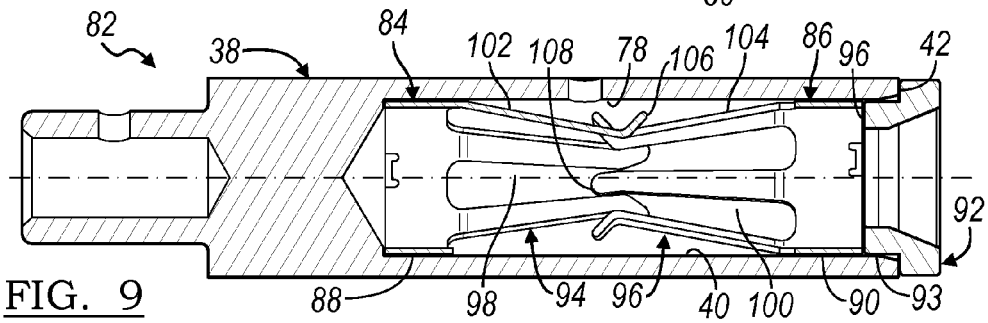
FIG. 9 is a side section view of the receptacle assembly of FIG. 8.

Referring now to FIGS. 8 and 9, a receptacle assembly 82 is illustrated according to another embodiment. The receptacle assembly 82 may employ a common receptacle housing 38 as the prior embodiment. Accordingly, only new elements are assigned new reference numerals. A pair of terminals 84, 86 are provided within the receptacle 40. For the depicted embodiment, the terminals 84, 86 are identical. However, various terminal combinations may be employed.

Each terminal 84, 86 has a generally cylindrical body 88, 90 respectively. The body 88 of the first terminal 84 is inserted against the blind depth end 44. The body 90 of the second terminal 86 is inserted spaced apart from the body 88 of the first terminal 84 and is oriented near the opening 42 of the receptacle 40. A retainer 92 is provided with the body 93 having an abutment surface 96 against the body 90 of the terminal 86 thereby orienting the terminal 86 in a receptacle direction of the receptacle 40.

Each terminal 84, 86 has a radial array of leaf springs 94, 96 that are each spaced circumferentially apart with gaps 98, 100 between the corresponding leaf springs 94, 96. Each leaf spring 94, 96 has a first angled portion 102, 104 extending lengthwise from the body 88, 90 and extending centrally inward. Each leaf spring 94, 96 may also have a second angled portion 106, 108 that extends longitudinally away from the first angled portion 102, 104 and radially outward.

The terminals 84, 86 are axially aligned with the leaf springs 94, 96 oriented between the terminal bodies 88, 90. The leaf springs 94, 96 may overlap within a common region of the receptacle 40. For clearance, the leaf springs 94 of the first terminal 84 extending to the gaps 100 between the leaf springs 96 of the second terminal 86. Likewise, the leaf springs 96 of the second terminal 86 extend into the gaps 98 between the leaf springs 94 of the first terminal 84.

By utilizing two terminals 84, 86 within one receptacle 40, a large number of leaf springs 94, 96 may be employed thereby enhancing contact with the pin 76. Likewise, by employing a pair of terminals 84, 86 a pair of bodies 88, 90 are utilized for engaging the receptacle housing 38 thereby increasing contact between the terminals 84, 86 and the housing 38.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A receptacle assembly comprising:

a housing having at least one receptacle formed therein;

a terminal received within the receptacle, the terminal comprising:

a body sized to be received within a receptacle, an intermediate region extending lengthwise from the body in a receptacle direction, at least one portion of the intermediate region extending centrally inward into the receptacle to receive a pin to deform and maintain contact with the received pin, and a retention member provided on a distal end of the at least one portion of the intermediate region that extends centrally inward to engage an inner wall of the receptacle and, during deformation, to extend along the wall thereby providing a reaction force to the at least one portion of the intermediate region to enhance contact with the pin and to enhance contact with the receptacle; and a retainer provided on an opening of the receptacle to retain the terminal therein;

wherein the retainer has an inner diameter less than that of the receptacle;

wherein the retainer has an inclined surface tapered from the receptacle centrally inward toward a depth direction of the receptacle; and wherein at least a portion of the inclined surface is oriented inboard of the terminal retention member such that the terminal retention member contacts the inclined surface during deformation.

2. The receptacle assembly of claim 1 wherein the receptacle has a depth; and wherein the retention member engages a retainer proximate a receptacle opening whereby the body is pressed against the depth of the receptacle thereby axially loading the terminal.

3. The receptacle assembly of claim 1 wherein the terminal is generally cylindrical.

4. The receptacle assembly of claim 1 wherein the housing has a plurality of receptacles formed therein; and wherein the receptacle assembly further comprises:

a plurality terminals, each received within one of the plurality of receptacles, and a plurality of retainers each provided on an opening of one of the receptacles to retain the terminals therein.

5. The receptacle assembly of claim 1 wherein the intermediate region comprises a series of leaf springs extending lengthwise from the body and centrally inward.

6. The receptacle assembly of claim 5 wherein the leaf spring comprises:

a first angled portion extending centrally inward from the body; and a second angled portion extending radially outward from the first angled portion to the retention member.

7. The receptacle assembly terminal of claim 5 wherein the retention member comprises a series of retention members each provided on a distal end of one of the leaf springs.

8. The receptacle assembly of claim 7 wherein the series of retention members are collectively oriented in a radial array.

9. The receptacle assembly of claim 1 wherein the centrally extending portion of the intermediate region comprises a leaf spring; and wherein the retention member is oriented on the distal end of the leaf spring such that each leaf spring has two contact points with the receptacle.

10. The receptacle assembly of claim 9 wherein the retention member has a distal end abutment surface to engage a retainer proximate a receptacle opening.

11. The receptacle assembly of claim 9 wherein the retention member comprises a lengthwise extending portion to translate along the wall as the leaf spring expands.

12. The receptacle assembly of claim 1 wherein the terminal is formed integrally from a single sheet of stamped spring metal.

13. The receptacle assembly of claim 12 wherein the sheet of spring metal has a thickness, a length terminating at proximal and distal ends, and a width terminating at lateral ends; and wherein the sheet is rolled about a lengthwise axis such that the lateral ends are joined together.

14. A terminal assembly comprising:

a first terminal comprising:

a body sized to be received within a receptacle, and a series of radially spaced apart leaf springs extending lengthwise from the body in a receptacle direction, and extending centrally inward into the receptacle to receive a pin to deform and maintain contact with the received pin; and a second terminal comprising:

a body sized to be received within the receptacle, and a series of radially spaced apart leaf springs extending lengthwise from the body in the receptacle direction, and extending centrally inward into the receptacle to receive the pin to deform and maintain contact with the received pin;

wherein the first and second terminals are oriented axially aligned with the first and second terminal bodies spaced apart from each other with the first and second series of radially spaced apart leaf springs oriented between the first and second terminal bodies; and wherein the first and second terminals are oriented such that distal ends of the first and second series of leaf springs overlap a common receptacle region.

15. The terminal assembly of claim 14 wherein the first and second terminals are oriented such that the distal ends of the first series of leaf springs are oriented in gaps between the distal ends of the second series of leaf springs.

16. A receptacle assembly comprising:

a housing having at least one receptacle formed therein;

a terminal assembly according to claim 14 received within the receptacle with the first terminal body oriented adjacent to a depth of the receptacle; and a retainer provided on an opening of the receptacle to retain the terminal assembly therein with the second terminal body oriented adjacent thereto.

17. The receptacle assembly of claim 16 wherein the housing has a plurality of receptacles formed therein; and wherein the receptacle assembly further comprises:

a plurality terminal assemblies, each received within one of the plurality of receptacles, and a plurality of retainers each provided on an opening of one of the receptacles to retain the terminals therein.

* * * * *